US009639052B2

(12) United States Patent
Miwa et al.

(10) Patent No.: US 9,639,052 B2
(45) Date of Patent: May 2, 2017

(54) IMAGE FORMING APPARATUS HAVING A HANDLE WITH A PROTRUSIVE PART AND A CONVEX PART TO COVER THE PROTRUSIVE PART

(71) Applicant: Brother Kogyo Kabushiki Kaisha, Nagoya-shi, Aichi-ken (JP)

(72) Inventors: Atsushi Miwa, Anjo (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/924,797

(22) Filed: Oct. 28, 2015

(65) Prior Publication Data

US 2016/0124380 A1 May 5, 2016

(30) Foreign Application Priority Data

Oct. 31, 2014 (JP) ..... 2014-223001

(51) Int. Cl.
*G03G 21/16* (2006.01)

(52) U.S. Cl.
CPC ..... *G03G 21/1619* (2013.01); *G03G 21/1633* (2013.01)

(58) Field of Classification Search
CPC ..... G03G 21/1619
USPC ..... 399/107
See application file for complete search history.

(56) References Cited

U.S. PATENT DOCUMENTS

| | | | | |
|---|---|---|---|---|
| 7,246,963 | B2 | 7/2007 | Nishimura | |
| 9,075,389 | B2 | 7/2015 | Miwa | |
| 2005/0141947 | A1 | 6/2005 | Nishimura | |
| 2013/0164033 | A1* | 6/2013 | Okabe | G03G 21/1633 399/119 |
| 2013/0259518 | A1 | 10/2013 | Miwa | |
| 2014/0161489 | A1* | 6/2014 | Niikawa et al. | G03G 21/1647 399/167 |

FOREIGN PATENT DOCUMENTS

| | | |
|---|---|---|
| JP | 2005-173285 A | 6/2005 |
| JP | 2005-195704 A | 7/2005 |
| JP | 2013-210539 A | 10/2013 |

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus, including an image forming unit configured to form an image on a sheet in an electrophotographic method and detachably attached to a body of the image forming apparatus; a chassis configured to accommodate the image forming unit and including an opening portion, through which the image forming unit is detachably attached to the body; a handle arranged in the image forming unit to protrude at least partly through the opening portion when the image forming unit is attached to the body; and a cover movable between a closed position, in which the opening portion is closed, and an open position, in which the opening portion is exposed, the cover including a protrusion cover configured to cover a protrusive part of the handle protruded through the opening portion when the cover is in the closed position, is provided.

10 Claims, 8 Drawing Sheets

IMAGE FORMING APPARATUS HAVING A HANDLE WITH A PROTRUSIVE PART AND A CONVEX PART TO COVER THE PROTRUSIVE PART

CROSS REFERENCE TO RELATED APPLICATION

This application claims priority from Japanese Patent Application No. 2014-223001 filed on Oct. 31, 2014, the entire subject matter of which is incorporated herein by reference.

BACKGROUND

Technical Field

An aspect of the present invention relates to an image forming apparatus capable of forming an image on a sheet in an electro-photographic method.

Related Art

An image forming apparatus having an image forming unit, which is detachable from a body of the image forming apparatus, is known. The detachable image forming unit may contain consumable or exchangeable items such as a developer agent and a photosensitive drum, and the image forming unit may be attached to or detached from the body of the image forming apparatus along with the consumable or exchangeable items.

SUMMARY

The detachable image forming unit may have a handle, by which a user may hold the image forming unit to attach to or detach from the body of the image forming apparatus.

The present invention is advantageous in that an image forming apparatus, in which operability for a user to attach to and detach from the body of the image forming apparatus along with the consumable or exchangeable items may be improved, is provided.

According to an aspect of the present invention, an image forming apparatus, including an image forming unit configured to form an image on a sheet in an electro-photographic method, the image forming unit being detachably attached to a body of the image forming apparatus; a chassis configured to accommodate the image forming unit and including an opening portion, through which the image forming unit is detachably attached to the body; a handle arranged in the image forming unit to protrude at least partly through the opening portion when the image forming unit is attached to the body; and a cover configured to be movable between a closed position, in which the opening portion is closed, and an open position, in which the opening portion is exposed, the cover including a protrusion cover configured to cover a protrusive part of the handle protruded through the opening portion when the cover is in the closed position, is provided.

BRIEF DESCRIPTION OF THE ACCOMPANYING DRAWINGS

DETAILED DESCRIPTION

Figure 1:
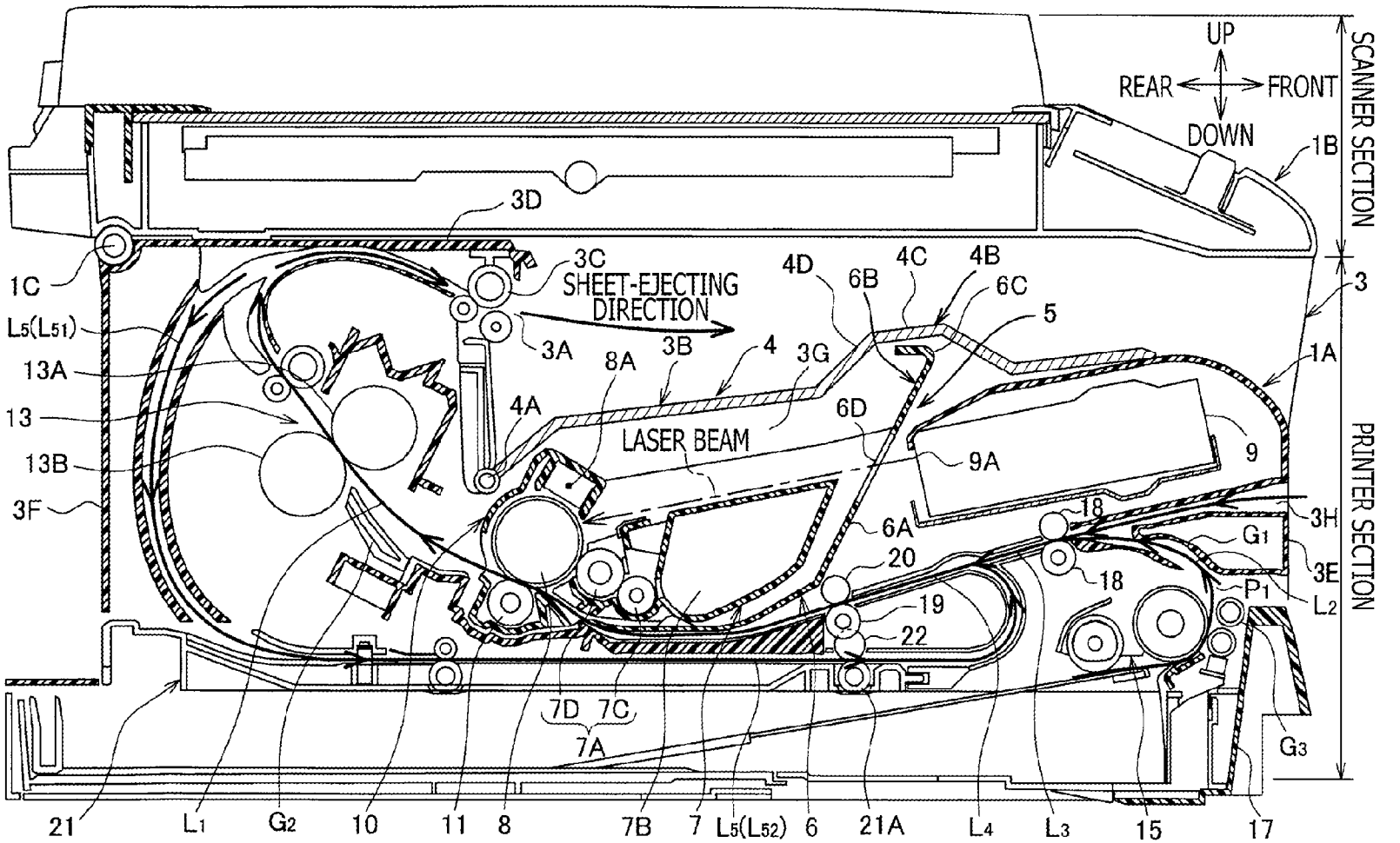
FIG. 1 is a cross-sectional side view of an image forming apparatus 1 according to an embodiment of the present invention.

Hereinafter, an image forming apparatus 1 representing an embodiment of the present disclosure will be described with reference to the accompanying drawings. It is noted that various connections are set forth between elements in the following description. These connections in general, and unless specified otherwise, may be direct or indirect, and this specification is not intended to be limiting in this respect.

In the embodiment described below, directions concerning the image forming apparatus 1 and each part or item included in the image forming apparatus 1 will be referred to based on orientations indicated by arrows shown in each drawing. In this regard, a right-to-left or left-to-right direction of the image forming apparatus 1 may also be referred to as a right-left direction or a widthwise direction. An up-to-down or down-to-up direction corresponds to a vertical direction of the image forming apparatus 1. The front-to-rear or rear-to-front direction may be referred to as a front-rear direction or a direction of depth. However, the orientations concerning the image forming apparatus 1 may not necessarily be limited to those described below or indicated in the accompanying drawings. Further, it is noted that a quantity of each of the parts and items denoted by reference signs is, unless otherwise noted, at least one.

1. Overall Configuration of the Image Forming Apparatus

An overall configuration of the image forming apparatus 1 will be described with reference to FIG. 1. The image forming apparatus 1 includes a printer section 1A and a scanner section 1B. The printer section 1A includes a printing apparatus capable of forming an image on a sheet of, for example, paper. The scanner section 1B includes an image reading apparatus capable of reading an image of an original sheet. An image referred to in this description may include written text, letters, and characters.

The scanner section 1B is disposed in an upper position with respect to the printer section 1A. In a lower position with respect to the scanner section 1B, disposed is a sheet outlet tray 3B, on which a sheet with an image formed thereon may be placed.

The scanner section 1B is coupled swingably to the printer section 1A through a hinge 1C. The hinge 1C is disposed in an upper position on a rear side in the printer section 1A.

The rear side of the printer section 1A is on a side opposite from the front side, for which the sheet being conveyed to be ejected on the sheet outlet tray 3B is headed. With regard to FIG. 1, the right-hand side and the left-hand side for a viewer are the front side and the rear side of the printer section 1A, respectively.

2. Overall Configuration of the Printer Section

In a chassis 3 of the printer section 1A, contained is an image forming system 5, in which an image is formed on the sheet. In an upper position in the chassis 3, arranged are a sheet outlet 3A and the sheet outlet tray 3B. The sheet outlet 3A is an opening, through which the sheet with the image formed thereon is ejected.

The sheet ejected outside the chassis 3 through the sheet outlet 3A is placed on the sheet outlet tray 3B. An ejection roller 3C is disposed by the sheet outlet 3A to convey the sheet to the sheet outlet tray 3B through the sheet outlet 3A. The ejection roller 3C is bi-directionally rotatable to convey the sheet to be ejected toward the sheet outlet tray 3B and to reverse a conveying direction for the sheet to return the sheet to the image forming system 5.

In other words, the ejection roller 3C may be switchable between a normal rotation, in which the sheet is conveyed toward the sheet outlet tray 3B, and a reverse rotation, in which the sheet may be switched back to return once again to the image forming system 5.

The chassis 3 includes a top cover 3D, a pair of lateral covers (not shown), a front cover 3E, and a rear cover 3F. The top cover 3D is arranged to cover an upper part of the printer section 1A. The lateral covers are arranged to cover a rightward side and a leftward side of the printer section 1A to provide exterior lateral faces of the printer section 1A. The front cover 3E is arranged to cover a front side of the printer section 1A to provide an exterior front face of the printer section 1A. The rear cover 3F is arranged to cover a rear side of the printer section 1A to provide an exterior rear face of the printer section 1A.

The front cover 3E is formed to have a manual-feeder inlet 3H, through which the sheet may be inserted to be fed to the image forming system 5 without being conveyed by a feeder unit 15. The feeder unit 15 will be described later in detail.

The image forming system 5 transfers an image onto the sheet in an electro-photographic method to form the image. The image forming system 5 includes, as shown in FIG. 1, an image forming unit 6, an exposure device 9, a transfer device 11, and a fixing device 13.

The image forming unit 6 is detachably attached to a body of the image forming apparatus 1 through an opening portion 3G, which is a hole formed in the chassis 3. The opening portion 3G is formed on an upper face, i.e., on the top cover 3D, and a room inside the chassis 3 may be exposed upward through the opening portion 3G. The body in the present embodiment refers to a part of the image forming apparatus 1 that may not be disassembled or removed by a user and may include the chassis 3 and a frame (not shown). The frame may include a plate arranged on each side of the image forming system 5 along a horizontal direction. Each part or device that forms the image forming system 5 may be mounted on the frame.

The opening portion 3G may be covered by a cover 4. The cover 4 is movable between a closed position, in which the opening portion 3G is closed, and an open position, in which the opening portion 3G is exposed. A top plane of the cover 4 provides the sheet outlet tray 3B. In other words, the cover 4 includes the sheet outlet tray 3B so that, when the cover 4 is in the closed position, the cover 4 may serve as the sheet outlet tray 3B.

A position of the opening portion 3G is identical to a position of the sheet outlet 3B in the chassis 3 (the top cover 3D), i.e., a position of the cover 4 in the closed position. Therefore, the position of the opening portion 3G coincides with a placement surface of the sheet outlet tray 3B, which is the sheet outlet tray 3B not including a convex part 4B, as indicated in a double-dotted line in FIG. 2.

The cover 4 is movably coupled to the top cover 3D through a hinge 4A. The hinge 4A is disposed on one end of the cover 4 closer to the sheet outlet 3A with regard to the front-rear direction, i.e., on a rear end of the cover 4.

Figure 2:
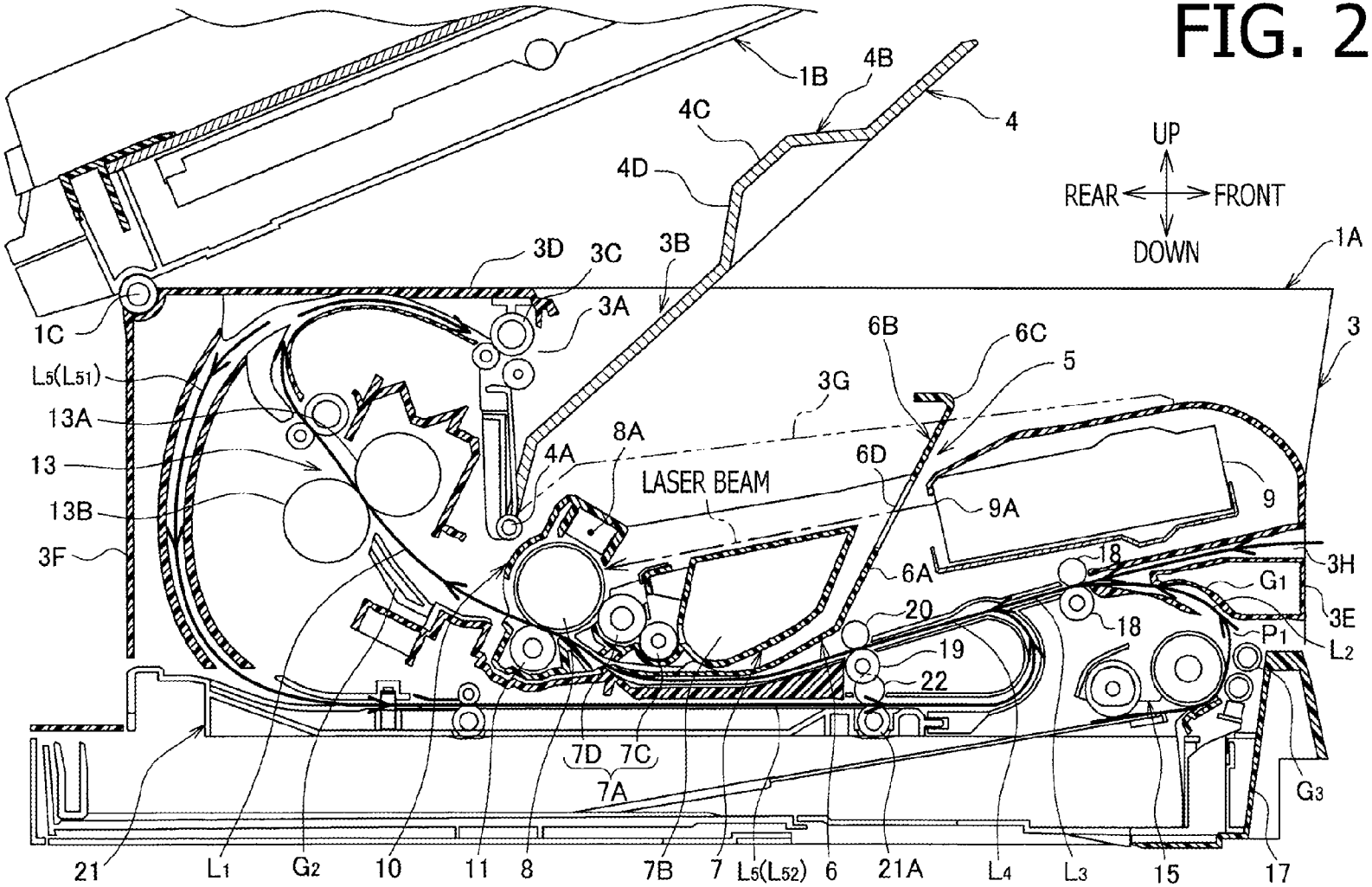
FIG. 2 is a cross-sectional side view of the image forming apparatus 1 according to the embodiment of the present invention with a scanner section 1B being uplifted.

When the image forming unit 6 is detached from the body of the image forming apparatus 1, the user may shift the scanner section 1B upward and place the cover 4 in the open position, as shown in FIG. 2. Thereby, the image forming unit 6 accommodated in the chassis 3 may be moved out of the chassis 3 through the opening portion 3G.

The image forming unit 6 includes a container unit 7 and a drum unit 10, which are supported by a support member 6A. The container unit 7 may be detachably attached to the support member 6A. The drum unit 10 may not be detachable from the support member 6A but may be integrally formed with the support member 6A.

The container unit 7 includes a developer device 7A and a container 7B. The developer device 7A supplies a developer agent contained in the container 7B to a photosensitive drum 8. The developer device 7A includes a developer roller 7D and a supplier roller 7E. The drum unit 10 includes the photosensitive drum 8 and a charger device 8A.

Thus, the image forming unit 6 includes the photosensitive drum 8, the charger device 8A, the developer device 7A, and the container 7B. Therefore, when the cover 4 is in the open position, the image forming unit 6 is detachable from the body, and the container 7 is detachable from the support member 6A (the image forming unit 6) and from the drum unit 10.

The photosensitive drum 8 may carry an image formed in the developer agent on a surface thereof. The charger device 8A may charge the surface of the photosensitive drum 8. The exposure device 9 may emit a laser beam and scan the charged surface of the photosensitive drum 8 by the laser beam to expose the photosensitive drum 8 selectively to the emitted laser beam. Thereby, a latent image may be formed on the surface of the photosensitive drum 8.

The latent image formed on the surface of the photosensitive drum 8 may be supplied with the developer agent and developed into an image formed in the developer agent. Meanwhile, in a position to face with the photosensitive drum 8, disposed is a transfer device 11, which may transfer the developed image carried on the photosensitive drum 8 onto the sheet.

The fixing device 13 may fix the transferred image on the sheet thereat. The sheet exiting the fixing device 13 may be conveyed toward the ejection roller 3C. The fixing device 13 may include a heat roller 13A to heat the developer agent on the sheet and a pressure roller 13B to press the sheet against the heat roller 13B.

A sheet-nipping position between the heat roller 13A and the pressure roller 13B, at which the sheet contacts the fixing device 13, is in an upper position with respect to a position, at which the sheet contacts the photosensitive drum 8. Therefore, a sheet conveyer path L1 extending from the photosensitive drum 8 to the fixing device 13 may incline with respect to the horizontal direction. The sheet conveyer path L1 may include at least a second conveyer guide G2.

On an upstream side of the image forming system 5 with regard to the conveying direction, disposed is the feeder unit 15, which may pick up sheets from a feeder tray 17 one by one and convey toward the image forming system 5. The feeder tray 17 may be detachably attached to the body, at a lower position with respect to the image forming unit 6.

In the printer section 1A, the exposure device 9 and the image forming unit 6 are arranged in lower positions with respect to the sheet outlet tray 3B (or the cover 4) and in upper positions with respect to the feeder tray 17, in the order mentioned above with regard to the front-to-rear direction. More specifically, with regard to the front-to-rear direction, the exposure device 9, the container 7B, the developer device 7A, the photosensitive drum 8, and the fixing device 13 are arranged in the order given.

The sheet picked up from the feeder tray 17 is conveyed in a U-shaped conveyer path L2 to the photosensitive drum 8. A first conveyer guide G1, which forms at least a part of the U-shaped conveyer path L2 may turn the conveying direction for the sheet to curve in a shape of "U."

The conveying direction of the sheet picked up by the feeder unit 15 may be turned approximately 180 degrees by a guide roller G3 and the first conveyer guide G1. In the following description, an area, in which the conveying direction to convey the sheet aligns with the vertical direction, in the U-shaped conveyer path L2 may be referred to as a turning point P1.

In a post-turn conveyer path L3, which is extended rearward from the turning point P1, formed is a slanted path L4. The post-turn conveyer path L3 forms a part of the U-shaped conveyer path L2, in which the sheet is conveyed to head for the photosensitive drum 8 along the conveying direction. The slanted path L4 forms a part of the post-turn conveyer path L3 and inclines to be lower toward the photosensitive drum 8.

In the U-shaped conveyer path L2, arranged are a pair of first conveyer rollers 18 and a pair of second conveyer rollers 19, 20. The first and second conveyer rollers 18-20 convey the sheet toward the image forming unit 6, i.e., toward the image forming system 5.

The pair of first conveyer rollers 18 are disposed at a merging point, at which a conveyer path extending from the manual-feeder inlet 3H to the slanted path L4 merges with the U-shaped conveyer path L2. The second conveyer rollers 19, 20 are arranged in the slanted path L4.

The second conveyer rollers 19, 20 are arranged on an upstream side of the image forming unit 6 (or the photosensitive drum 8) with regard to the conveying direction and may serve to correct an orientation of the sheet being conveyed with respect to the conveying direction. Therefore, the second conveyer rollers 19, 20 may be called as registration rollers.

Figure 3:
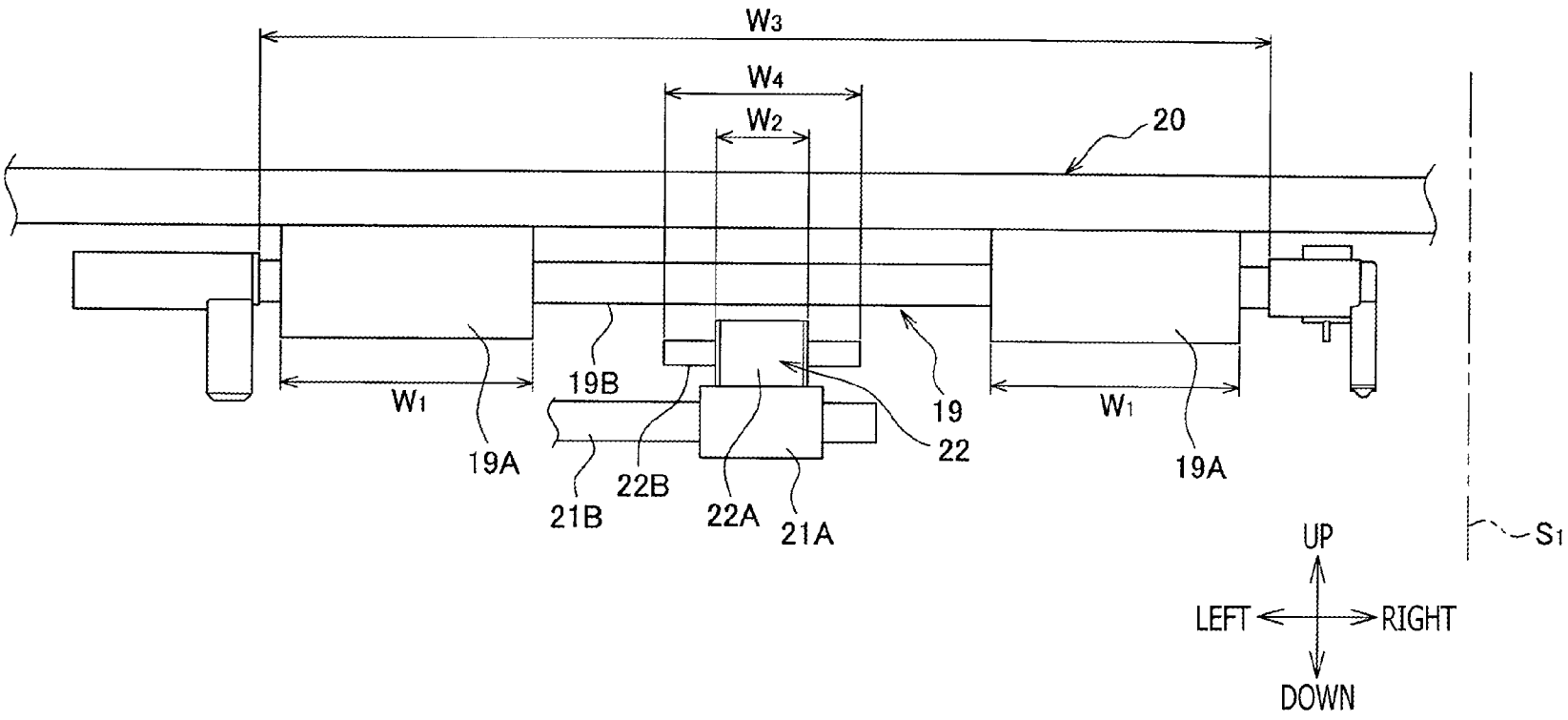
FIG. 3 is a projective view of a driving registration roller 19 and a duplex conveyer roller 22 projected on a second virtual plane S2 according to the embodiment of the present invention.

The second conveyer roller 19 includes at least one roller cylinder 19A and a roller shaft 19B, to which the roller cylinder 19A is fixed. As shown in FIG. 3, in the image forming apparatus 1 in the present embodiment, the second conveyer roller 19 includes two (2) roller cylinders 19A.

A diameter of the roller shaft 19B is smaller than a diameter of the roller cylinder 19A. A widthwise dimension W1 of the roller cylinder 19A along an axial direction of the second conveyer roller 19 is smaller than a widthwise dimension W3 of the roller shaft 19B along the axial direction.

The roller cylinder 19A may contact the sheet and rotate. The roller cylinder 19A may be made of a material, of which friction coefficient is relatively large, such as rubber. Meanwhile, a driving force may be transmitted to the roller shaft 19B continuously or intermittently. The second conveyer roller 19 serves as a driving conveyer roller, which receives the driving force and applies a conveying force to the sheet. In the following description, the second conveyer roller 19 may be referred to as a driving registration roller 19.

The second conveyer roller 20 is a driven roller, which may be rotated along with rotation of the driving registration roller 19. The second conveyer roller 20 is formed to have a constant diameter lengthwise along an axial direction of the second conveyer roller 20. In the following description, the second conveyer roller 20 may be referred to as a registration pinch roller 20.

In order to correct the orientation of the sheet with respect to the conveying direction by the second conveyer rollers 19, 20, when a leading end of the sheet reaches the driving registration roller 19, or immediately before the leading end of the sheet reaches the driving roller 19, the driving force to the driving registration roller 19 is shut off. Thereby, the leading end of the sheet may be placed to align along an outer periphery of the registration pinch roller 20, and the sheet may align with the conveying direction. After a predetermined length of period from the shutoff of the driving force to the driving registration roller 19, transmission of the driving force to the driving registration roller 19 may be resumed so that the sheet may be conveyed through the second conveyer rollers 19, 20 in the correct orientation.

3. Configuration of Duplex Conveyer Unit

The image forming apparatus 1 may form an image on either side or both sides of the sheet. For example, the image forming apparatus 1 may convey the sheet with an image formed on one side thereof to return to the image forming unit 6 in the image forming system 5 once again so that another image may be formed on the other side of the sheet.

The sheet reaching the ejection roller 3C may be switched back to be conveyed in a reverse direction by the reverse rotation of the ejection roller 3C through a duplex conveyer path L5 to the image forming unit 6 in the image forming system 5 (see FIG. 1).

The duplex conveyer path L5 may include a first duplex conveyer path L51 and a second duplex conveyer path L52. The first duplex conveyer path L51 may guide the sheet being conveyed rearward by the ejection roller 3C to travel downward and thereafter frontward.

The second duplex conveyer path L52 may guide the sheet conveyed from the rear side through the first duplex conveyer path 51 frontward to enter the post-turn conveyer path L3. Therefore, the sheet conveyed through the second duplex conveyer path 52 may be conveyed through at least a part of the post-turn conveyer path L3 to reach the image forming unit 6 in the image forming system 5.

A duplex conveyer unit 21 may form a part of the second duplex conveyer path L52. The duplex conveyer unit 21 is detachably attached to an upper position with respect to the feeder tray 17 in the chassis 3 and is disposed in a lower position with respect to the image forming system 5, or the image forming unit 6.

In the second duplex conveyer path L52, disposed is a duplex conveyer roller 22 to convey the sheet. As shown in FIG. 3, an axial direction of the duplex conveyer roller 22 may be in parallel with the axial direction of the roller shaft 19B of the driving registration roller 19.

The duplex conveyer roller 22 includes at least one roller cylinder 22A and a roller shaft 22A, to which the roller cylinder 22A is fixed. In the present embodiment, the duplex conveyer roller 22 includes one (1) roller cylinder 22A. The roller cylinder 22A may contact the sheet being conveyed and rotate.

A diameter of the roller shaft 22B is smaller than a diameter of the roller cylinder 22A. A widthwise dimension W2 of the roller cylinder 22A is smaller than a widthwise dimension W4 of the roller shaft 22B along the axial direction of the duplex conveyer roller 22.

The roller cylinders 19A of the driving registration roller 19 are displaced from the roller cylinder 22A of the duplex conveyer roller 22 along the axial direction. When the driving registration roller 19 and the duplex conveyer roller 22 are projected on a first virtual plane, which spreads orthogonally to the axial direction of the driving registration roller 19, the projection of the driving registration roller 19 including the roller cylinders 19A overlaps the projection of the duplex conveyer roller 22 at least partly (see FIG. 4).

Meanwhile, when the roller cylinders 19A are projected on a second virtual plane S2, which spreads orthogonally to the first virtual plane S1, as shown in FIG. 3, the projections of the roller cylinders 19A are arranged on each side the roller cylinder 22A along the axial direction.

Figure 4:
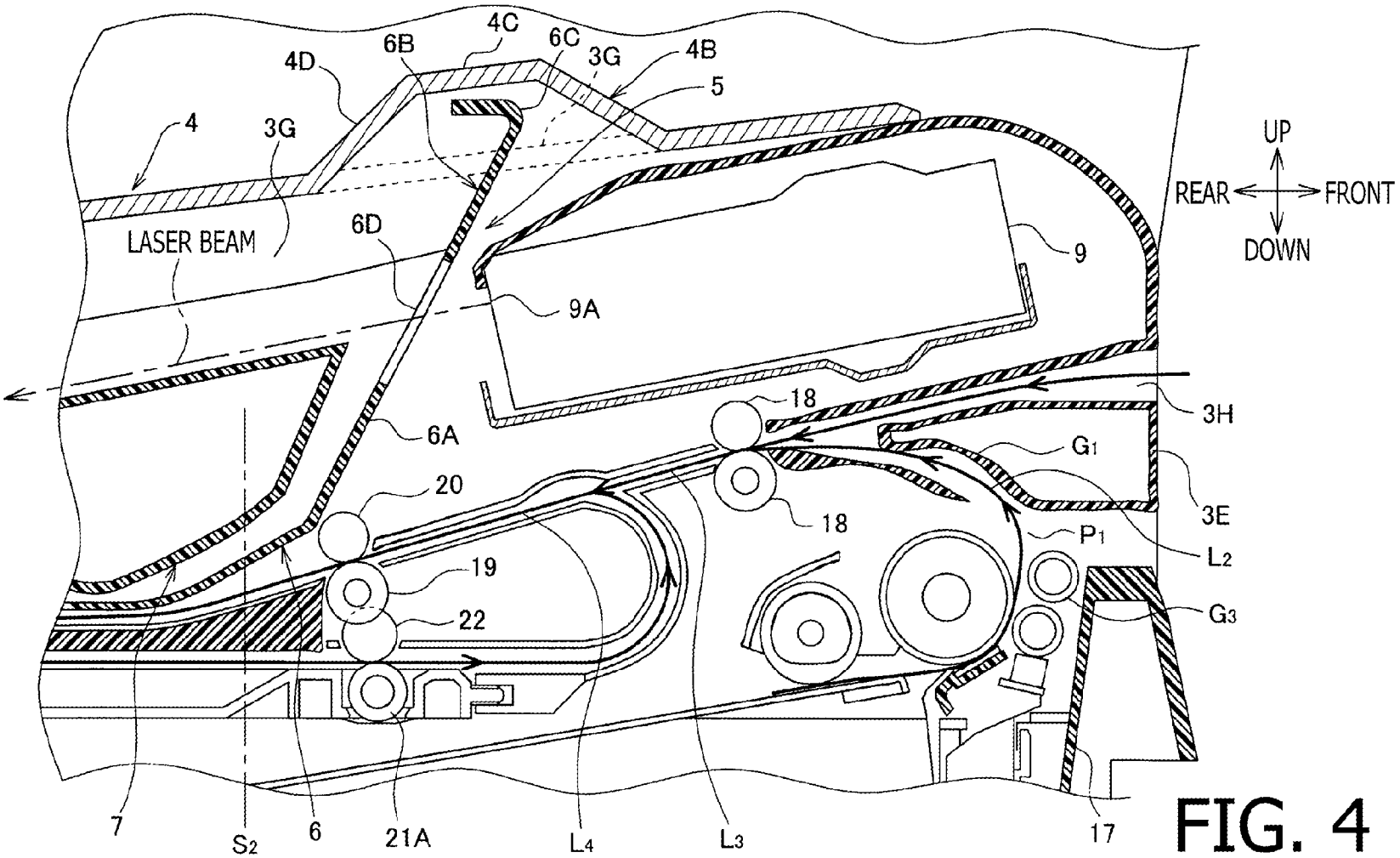
FIG. 4 is a projective view of the driving registration roller 19 and the duplex conveyer roller 22 projected on a first virtual plane S1 according to the embodiment of the present invention.

As shown in FIG. 4, the duplex conveyer roller 22 is disposed in a position closer than the photosensitive drum 8 to the turning point P1 with regard to the horizontal direction. The duplex conveyer roller 22 is rotatably attached to the body of the chassis 3 and is rotatable along with the conveyance of the sheet being conveyed in the second duplex conveyer path L52.

In the duplex conveyer unit 21, in a position to face with the duplex conveyer roller 22 across the second duplex conveyer path L52, disposed is a second duplex conveyer roller 21A. The second duplex conveyer roller 21A may contact the sheet being conveyed in the second duplex conveyer path L52 and rotate.

Figure 5:
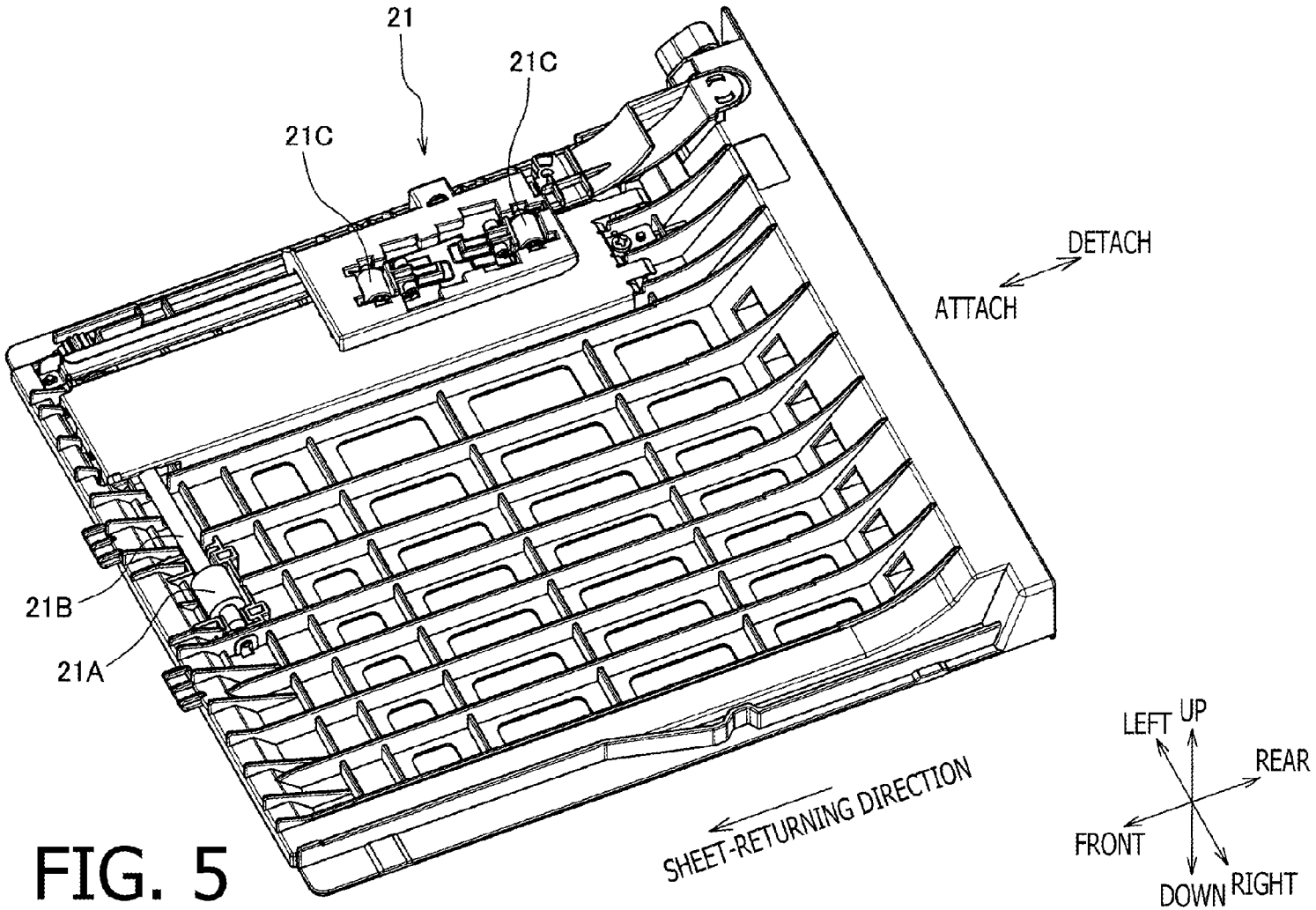
FIG. 5 is a perspective view of a duplex conveyer unit 21 in the image forming apparatus 1 according to the embodiment of the present invention.

The second duplex conveyer roller 21A may be rotated by a driving force, which may be transmitted through a drive shaft 21B (see FIG. 5). The duplex conveyer unit 21 includes a third duplex conveyer roller 21C, which may shift the sheet being conveyed in the duplex conveyer unit 21 sideward along the widthwise direction to correct skew of the sheet.

4. Configuration of the Image Forming Unit

Figure 6:
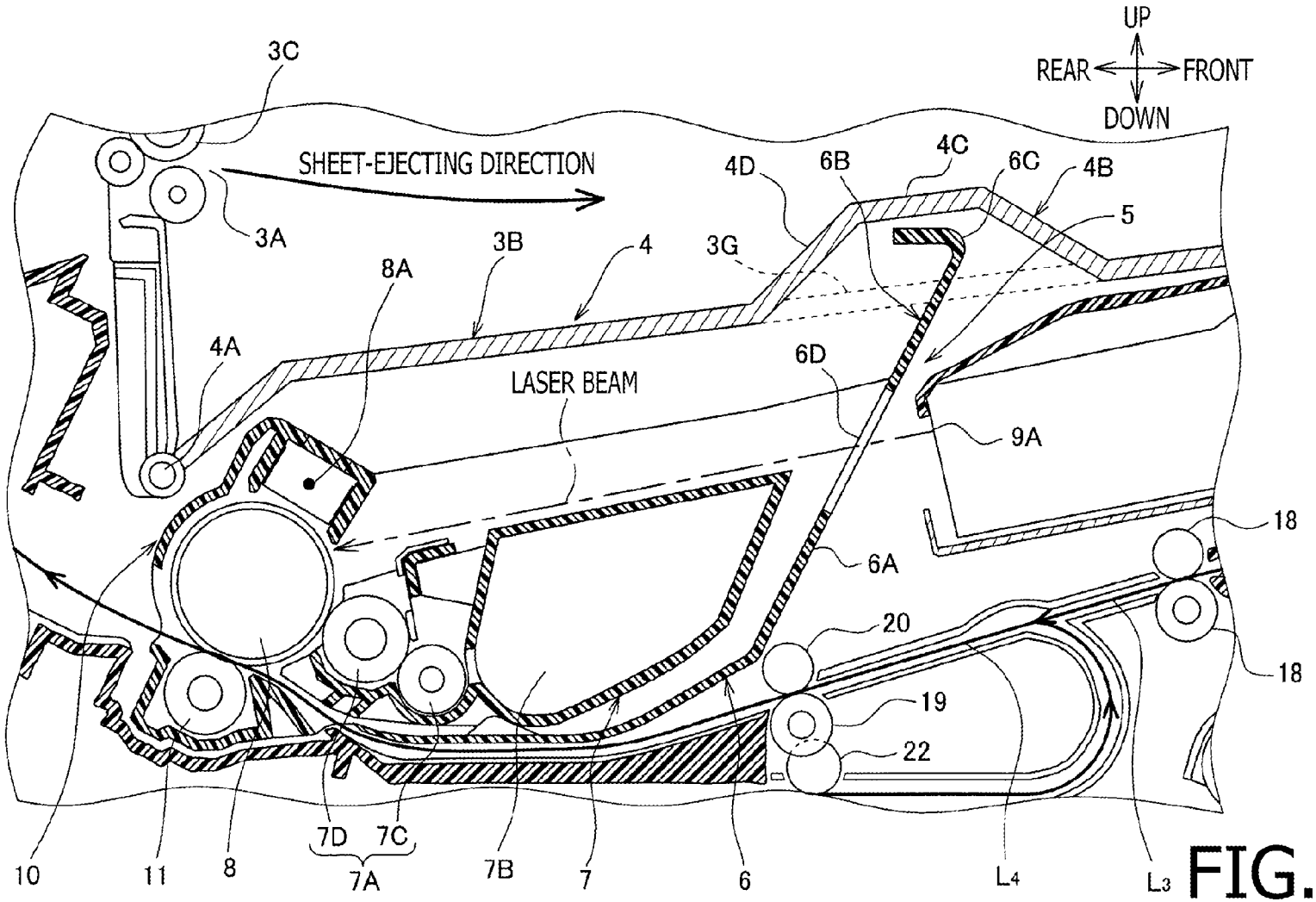
FIG. 6 is a cross-sectional side view of an image forming unit 6 in the image forming apparatus 1 according to the embodiment of the present invention.

As shown in FIG. 6, the image forming unit 6 includes a handle 6B, which may be held or gripped by the user when the image forming unit 6 is attached to or detached from the body. The handle 6B may be formed in the support member 6A.

The handle 6B is formed to protrude upward, when the image forming unit 6 is attached to the body, at least partly through the opening portion 3G. In the following description, the protrusive part of the handle 6B will be referred to as a handle tip 6C. In other words, the handle tip 6C is arranged to protrude from the chassis 3 outward beyond a rim of the opening portion 3G, which is indicated by broken lines in FIG. 6.

Meanwhile, the cover 4 is formed to have the convex part 4B, which may cover the handle tip 6C from above when the cover 4 is in the closed position. Therefore, a projection of the convex part 4B projected on the first virtual plane S1 overlaps a projection of a part of the handle tip 6C projected on the first virtual plane S1.

Figure 7:
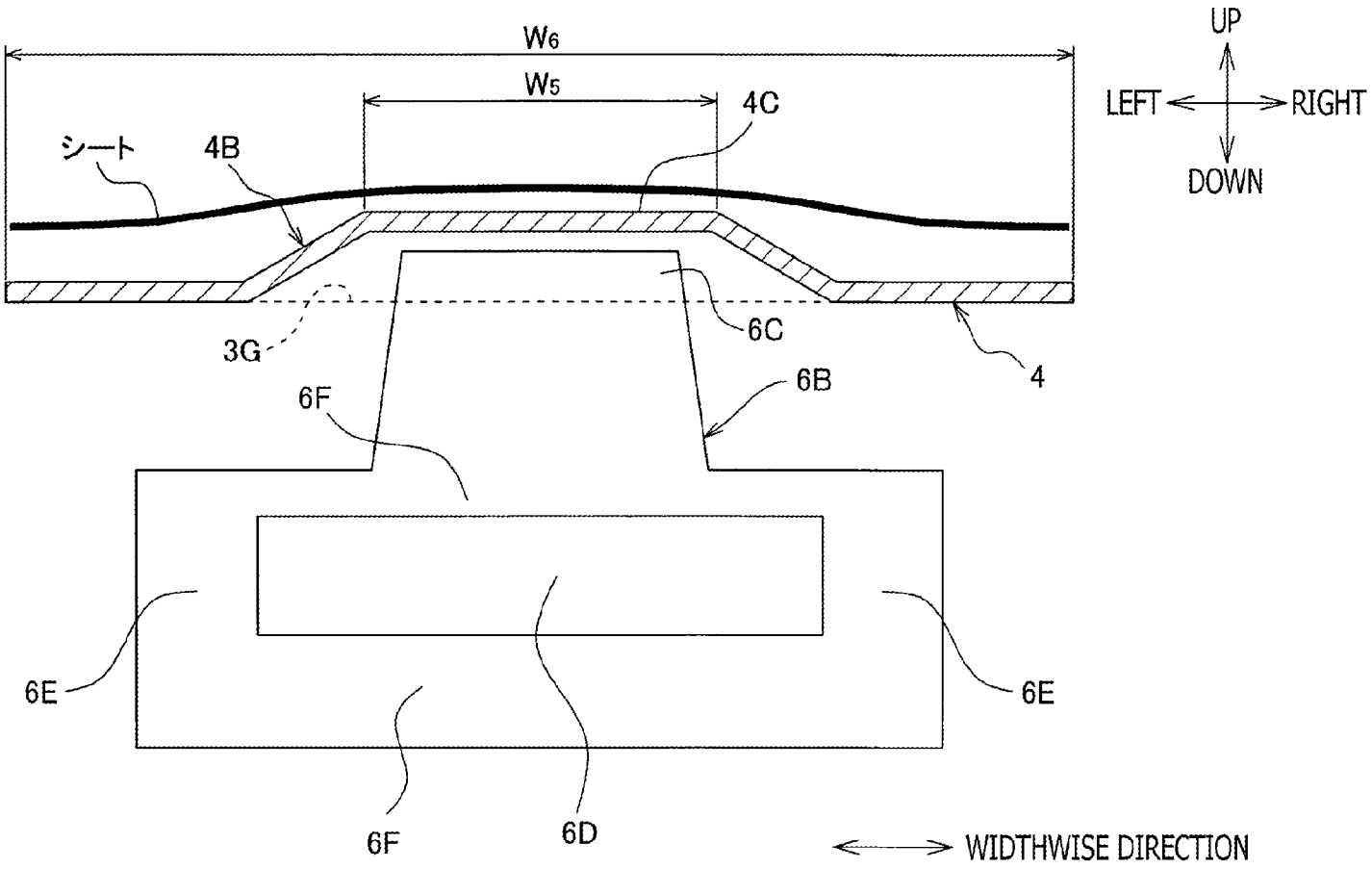
FIG. 7 is a projective view of a handle 6B in the image forming unit 6 projected on the second virtual plane S2 according to the embodiment of the present invention.

The convex part 4B is, as shown in FIG. 7, a part of the cover 4 formed to protrude upward. The area, in which the convex part 4B is formed, in the cover 4 forms a part of the sheet outlet tray 3B and is in an approximate central position in the cover 4 along the widthwise direction, which is parallel with the axial direction. Therefore, the sheet conveyed to the sheet outlet tray 3B is placed on the sheet outlet tray 3B in a convex-curved shape bulging upward, in the same protrusive direction as the convex part 4B.

An outline of the convex part 4B, in a cross-sectional view along the front-rear direction, may form a trapezoidal shape. In this regard, a ridge portion 4C being a protrusive end of the convex part 4B longitudinally extends along the widthwise direction, and a widthwise dimension W5 of the ridge portion 4C is smaller than a widthwise dimension W6 of the cover 4.

Figure 8:
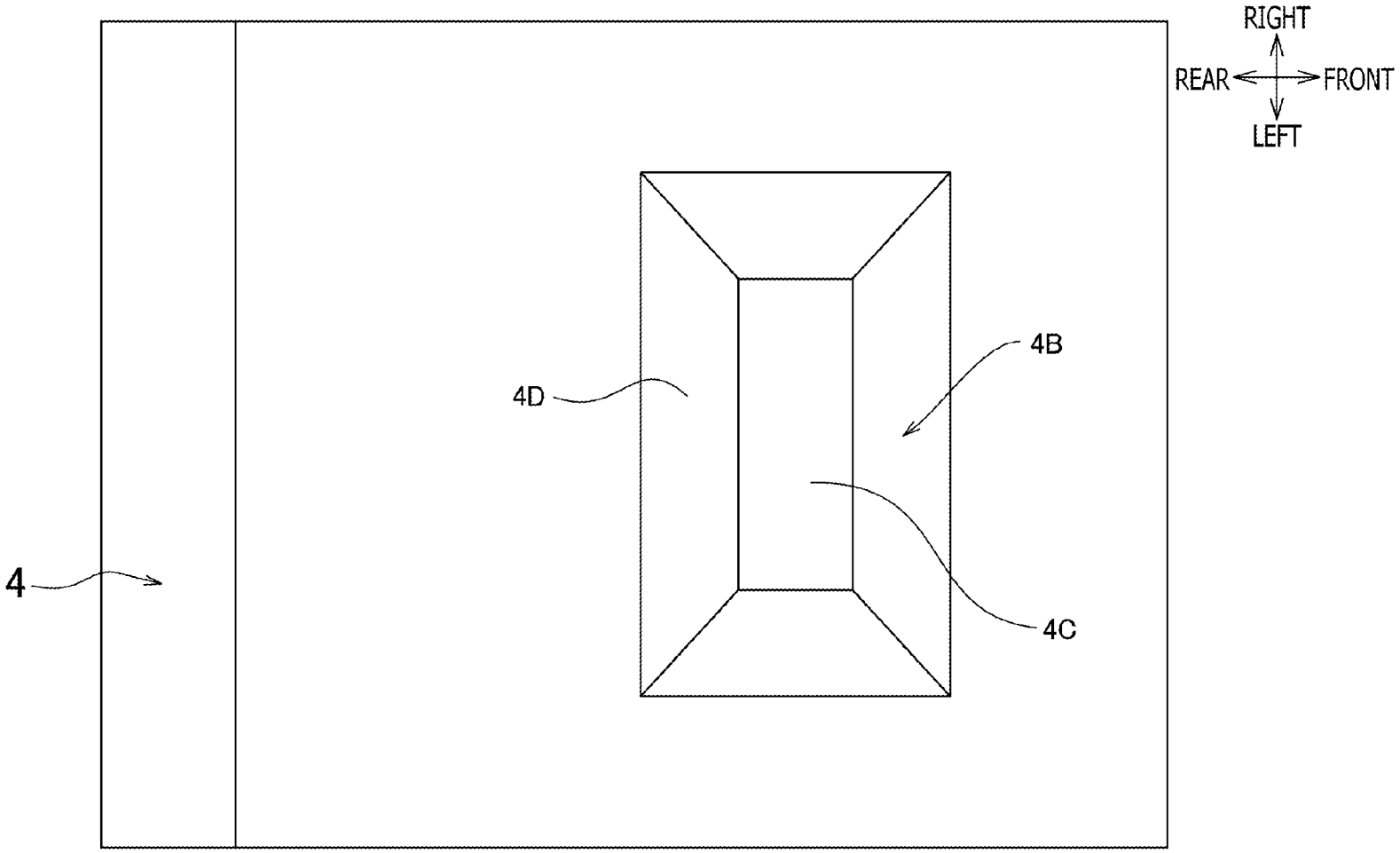
FIG. 8 is a top plane view of a cover 4 in the image forming apparatus 1 according to the embodiment of the present invention.

As shown in FIG. 8, the convex part 4B includes a slope surface 4D, at least on a side closer to the sheet outlet 3A, e.g., the rear side. The slope surface 4D inclines to be higher toward the front side as the slope surface 4D stretches to be farther away from the sheet outlet 3A (see FIG. 1).

The handle 6B is arranged in a position between the exposure device 9 and the photosensitive drum 8. In other words, the photosensitive drum 8 is arranged on one side of the handle 6B, and the exposure device 9 is arranged on the other side of the handle 6B opposite from the photosensitive drum 8 with regard to the front-rear direction. In a position to correspond to an emitter 9A of the exposure device 9, as shown in FIG. 6, arranged is a window 6D.

The window 6D is an area, through which the light emitted from the exposure device 9 may travel. For example, the window 6D may be a through-hole formed through the handle 6D. For another example, a transparent piece, through which the light from the exposure device 9 may transmit, may be disposed at the window 6D.

As shown in FIG. 7, on each widthwise side of the window 6D in the handle 6B, formed is a first frame part 6E. The pair of first frame parts 6E enclose the window 6D laterally. Further, on each vertical side of the window 6D in the handle 6B, formed is a second frame part 6F. The pair of second frame parts 6F enclose the window 6D vertically. The pair of first frames 6E and the pair of second frames 6F may be made of resin integrally together with the support member 6F. In this regard, the handle tip 6C is formed on an upper one of the paired second frames 6F.

4. Usability

According to the embodiment described above, the projection of the driving registration roller 19 projected on the first virtual plane S1, which spreads orthogonally to the axial direction, at least partly overlaps the projection of the duplex conveyer roller 22 projected on the same first virtual plane S1. Therefore, compared to an image forming apparatus, in which projections of paired registration rollers on a same virtual plane spreading orthogonally to a direction of axes do not overlap each other, a volume of the image forming apparatus 1 may be downsized.

According to the embodiment described above, the projection of the roller cylinder 19A of the registration roller 19 projected on the second virtual plane S2 is on each side of the roller cylinder 22A of the duplex conveyer roller 22 projected on the same second virtual plane S2. With this arrangement, the sheet may be restricted from being conveyed in a skewed orientation with respect to the conveying direction.

According to the embodiment described above, when the cover 4 is in the open position, a part of the handle 6B, in particular, the handle tip 6C, protrudes outward through the opening portion 3G. Therefore, the user may visually recognize the handle 6B easily, and operability to attach or detach the image forming unit 6 to or from the body may be improved.

According to the embodiment described above, the convex part 4B is arranged in the sheet outlet tray 3B in the cover 4. Therefore, for example, when the sheet being ejected on the sheet outlet tray 3B is curled into a roll, in a way such that the widthwise ends of the sheet are rounded in a same direction as the protrusive direction of the convex part 4B, the curl may be removed or straightened by the convex part 4B. In particular, while the convex part 4B is in the central position along the axial direction or the widthwise direction in the sheet outlet tray 3B, the curls of the sheet on the convex part 4B may be removed effectively.

Further, while the convex part 4B is arranged in the central position along the axial direction or the widthwise direction in the sheet outlet tray 3B, as shown in FIG. 7, a clearance may be reserved between each widthwise end of the sheet and the sheet outlet tray 3B. Therefore, the user may insert his/her fingers in the clearance to pick up the sheet from the sheet outlet tray 3B easily. In other words, operability of the MFD 1 may be improved.

5. More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the image forming unit 6 may not necessarily be formed integrally with the container unit 7 or the drum unit 10, but the container unit 7 and/or the drum unit 10 may be separately formed. In this configuration, the handle tip 6C in the handle 6B may be included in at least one of the container unit 7 and the drum unit 10.

For another example, the projection of the driving registration roller 19 projected on the first virtual plane S1 and the projection of the duplex conveyer roller 22 projected on the first virtual plane S1 may not necessarily overlap each other, but the projection of the driving registration roller 19 may overlap a projection of another roller(s) on the first virtual plane S1.

For another example, the quantity of the roller cylinder 19A in the driving registration roller 19 may not necessarily be limited to two (2), or the quantity of the roller cylinder 22A in the duplex conveyer roller 22 may not necessarily be limited to one (1). For another example, the duplex conveyer unit 21 may not necessarily be detachable from the body but may be fixed to the body.

For another example, the image forming unit 6 may not necessarily be detachable or attachable to the body through the opening portion 3B but may be detachable and attachable to the body through, for example the front side of the body.

For another example, the convex part 4B in the cover 4 may not necessarily be formed to have the slope surface 4D on the side closer to the sheet outlet 3A, but the slope surface 4D may be omitted or replaced with a vertical surface. For another example, the cover 4 may not necessarily be arranged to serve as the sheet outlet tray 3B, but the cover 4 and the sheet outlet tray 3B may be provided separately.

For another example, the handle 6B may not necessarily be formed to have the window 6D, but the exposure device 9 may be disposed in such an arrangement that the light path should not be interfered with by the handle 6B.

For another example, the embodiment described above may not necessarily be applied to a monochrome printer but may be applied to, for example, a color printer.

What is claimed is:

1. An image forming apparatus, comprising:

an image forming unit configured to form an image on a sheet in an electro-photographic method, the image forming unit being detachably attached to a body of the image forming apparatus;

a chassis configured to accommodate the image forming unit and comprising an opening portion, through which the image forming unit is detachably attached to the body;

a handle arranged in the image forming unit, the handle being arranged to protrude at least partly through the opening portion when the image forming unit is attached to the body;

a cover configured to be movable between a closed position, in which the opening portion is closed, and an open position, in which the opening portion is exposed, the cover comprising a convex part and configured to cover a protrusive part of the handle protruded through the opening portion when the cover is in the closed position, wherein the convex part is convex upwardly when the cover is in the closed position; and a conveyer roller configured to convey the sheet to the image forming unit, wherein a projection of the convex part projected on a virtual plane spreading orthogonally to an axial direction of the conveyer roller partly overlaps a projection of the handle projected on the virtual plane.

2. The image forming apparatus according to claim 1, wherein a ridge portion being a protrusive end of the convex part extends longitudinally along a widthwise direction parallel with the axial direction, and a dimension of the ridge portion along the widthwise direction is smaller than a dimension of the cover along the widthwise direction.

3. The image forming apparatus according to claim 1, wherein the cover comprises a sheet outlet tray configured to receive placement of the sheet with the image formed thereon.

4. The image forming apparatus according to claim 3, wherein the convex part is arranged on the sheet outlet tray in the cover.

5. The image forming apparatus according to claim 4, wherein the convex part is arranged in a central position in the axial direction on the sheet outlet tray.

6. The image forming apparatus according to claim 4, wherein the chassis comprises a sheet outlet, through which the sheet with the image formed thereon is ejected toward the sheet outlet tray, and wherein the convex part comprises a sloped surface on a side closer to the sheet outlet, the sloped surface inclining higher as the sloped surface extends farther away from the sheet outlet toward a side opposite from the sheet outlet.

7. The image forming apparatus according to claim 1, wherein the image forming unit comprises a photosensitive drum configured to carry the image formed in a developer agent, wherein an exposure device configured to emit light toward the photosensitive drum is arranged in the chassis at a position opposite from the photosensitive drum across the handle, and wherein the handle comprises a window, through which the light emitted from the exposure device travels.

8. The image forming apparatus according to claim 7, wherein the handle comprises a frame on each side of the window along a widthwise direction, the widthwise direction being parallel with an axial direction of the photosensitive drum.

9. The image forming apparatus according to claim 1, further comprising an image reading apparatus configured to read an image, the image reading apparatus being arranged in an upper position with respect to the cover.

10. The image forming apparatus according to claim 1, wherein the image forming unit comprises a container unit, in which a developer agent is contained.

* * * * *